US005141462A

United States Patent [19]

Latzel

[11] Patent Number: 5,141,462

[45] Date of Patent: Aug. 25, 1992

[54] TOY WATER CANNON APPARATUS

[76] Inventor: Michael R. Latzel, 232 Presley, St. Louis, Mo. 63137

[21] Appl. No.: 714,920

[22] Filed: Jun. 13, 1991

[51] Int. Cl.[5] ..... A63H 33/00; A63H 23/08; A63H 33/30; A63H 3/18

[52] U.S. Cl. ..... 446/28; 446/267; 446/473; 222/79; 224/148; 224/153; 224/209

[58] Field of Search ..... 446/15, 26, 27, 28, 446/29, 74, 220, 267, 473, 475, 483, 489, 490; 222/78, 79, 175; 224/148, 153, 209, 215

[56] References Cited

U.S. PATENT DOCUMENTS

| | | | |
|---|---|---|---|
| 1,902,548 | 3/1933 | Fenwick, Jr. | 222/175 X |
| 1,913,006 | 6/1933 | Smith | 222/148 |
| 2,122,606 | 7/1938 | Dobbie | 446/28 |
| 2,593,218 | 4/1952 | Swain | 446/28 X |
| 2,708,537 | 5/1955 | Dec | 446/473 X |
| 3,116,855 | 1/1964 | Thomson | 222/207 |
| 3,844,449 | 10/1974 | Alter | 222/175 |
| 3,980,216 | 9/1976 | Nye | 224/209 |
| 4,135,559 | 1/1979 | Barnby | 446/475 X |
| 4,257,460 | 3/1981 | Paranay et al. | 446/475 X |
| 4,586,456 | 5/1986 | Forward | 446/220 X |

FOREIGN PATENT DOCUMENTS

| | | | |
|---|---|---|---|
| 554089 | 11/1942 | United Kingdom | 222/175 |

*Primary Examiner*—Danton D. DeMille
*Assistant Examiner*—D. Neal Muir
*Attorney, Agent, or Firm*—Leon Gilden

[57] ABSTRACT

An apparatus wherein a squirt gun member includes a conduit in fluid communication with a housing, wherein the housing is arranged for mounting to a torso portion of an individual utilizing a waist and shoulder strap arrangement. A modified gun construction of the instant invention utilizes a projected balloon member formed with a tether line mounted to the gun structure of the instant invention.

2 Claims, 5 Drawing Sheets

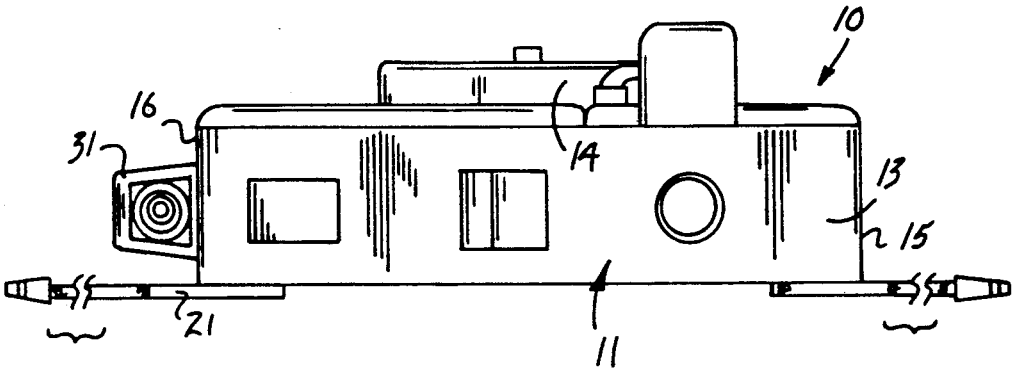
Fig 1
Fig 2
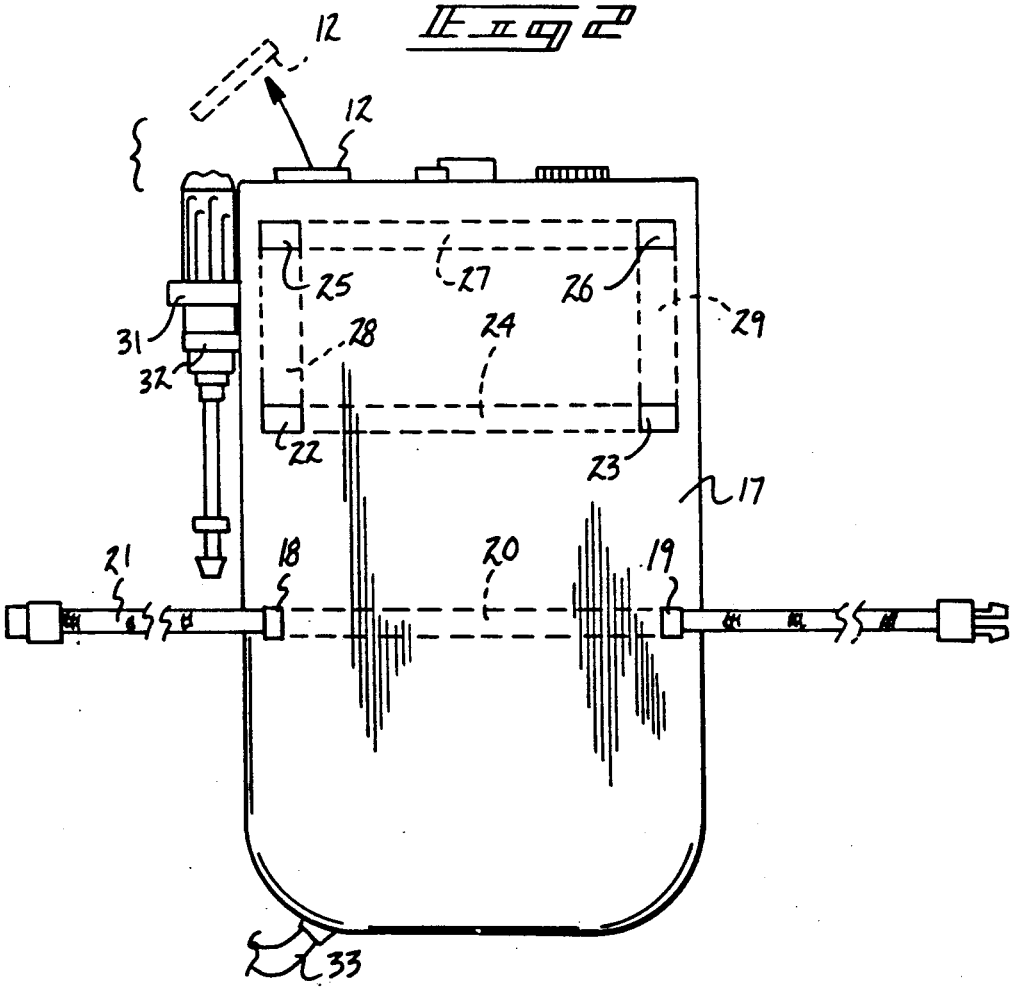

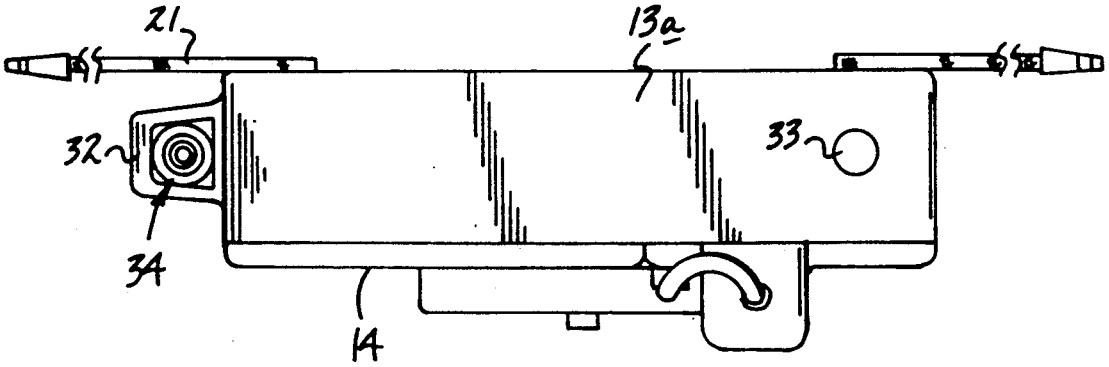
Fig 5
Fig 6
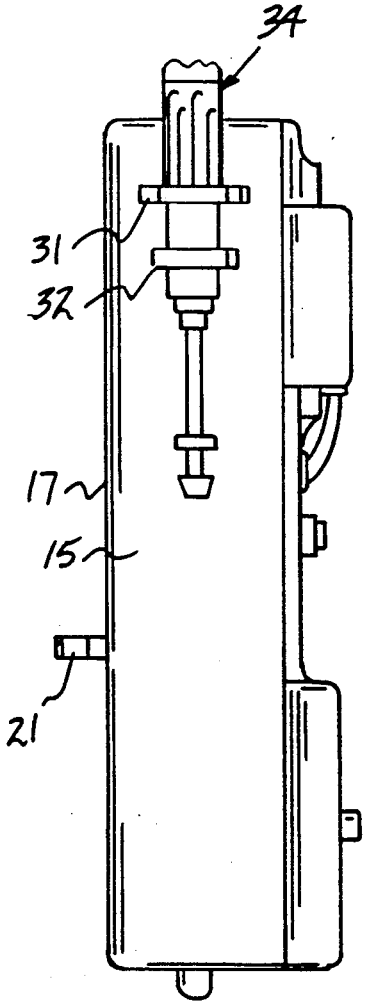

TOY WATER CANNON APPARATUS

BACKGROUND OF THE INVENTION

1. Field of the Invention

The field of invention relates to toy apparatus, and more particularly pertains to a new and improved toy apparatus wherein the same is arranged and constructed for simulation of a ghost combating organization.

2. Description of the Prior Art

Various to structures have been utilized in the prior art to enhance a child's imagination in the simulation of combat relative to various imaginary adversaries, such as soldiers, ghosts, and the like.

Examples of prior art water pistol type structures may be found in U.S. Pat. No. 2,573,954 to Casson wherein a water pistol includes a magazine for projecting a succession of water shots from a pistol.

U.S. Pat. No. 3,116,855 to Thomson sets forth a toy water gun provided with a remote trigger relative to a barrel structure for projecting water therefrom.

U.S. Pat. No. 3,575,318 to Kunz sets forth a toy water pistol including a detachably mounted and securable cartridge or magazine.

As such, it may be appreciated that there continues to be a need for a new and improved toy apparatus as set forth by the instant invention which addresses both the problems of ease of use as well as effectiveness in construction in simulation of a combat water squirt gun organization for the entertainment and amusement of a child.

SUMMARY OF THE INVENTION

In view of the foregoing disadvantages inherent in the known types of toy apparatus now present in the prior art, the present invention provides a toy apparatus wherein the same utilizes a remotely mounted water reservoir for securement about a torso, with a connecting conduit directed to a squirt gun member. As such, the general purpose of the present invention, which will be described subsequently in greater detail, is to provide a new and improved toy apparatus which has all the advantages of the prior art toy apparatus and none of the disadvantages.

To attain this, the present invention provides an apparatus wherein a squirt gun member includes a conduit in fluid communication with a housing, wherein the housing is arranged for mounting to a torso portion of an individual utilizing a waist and shoulder strap arrangement. A modified gun construction of the instant invention utilizes a projected balloon member formed with a tether line mounted to the gun structure of the instant invention.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and specially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy apparatus which has all the advantages of the prior art toy apparatus and none of the disadvantages.

It is another object of the present invention to provide a new and improved toy apparatus which may be easily and efficiently manufactured and marketed.

It is a further object of the present invention to provide a new and improved toy apparatus which is of a durable and reliable construction.

An even further object of the present invention is to provide a new and improved toy apparatus which is susceptible of a low cost of manufacture with regard to both materials and labor, and which is accordingly is then susceptible of low prices of sale to the consuming public, thereby making such toy apparatus economically available to the buying public.

Still yet another object of the present invention is to provide a new and improved toy apparatus which provides in the apparatuses and methods of the prior art some of the advantages thereof, while simultaneously overcoming some of the disadvantages normally associated therewith.

Still another object of the present invention is to provide a new and improved toy apparatus wherein the same is arranged for simulation of a combat organization in assaulting various adversaries such as ghosts, soldiers, and the like.

These together with other objects of the invention, along with the various features of novelity which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic top view of the instant invention.

FIG. 2 is an orthographic frontal view, taken in elevation, of the invention.

FIG. 5 is an orthographic bottom view of the instant invention.

FIG. 6 is an orthographic side view of the instant invention illustrating the associated squirt gun mounted on a right side wall.

FIG. 10 is an orthographic side view, partially in section, of the modified squirt gun utilized by the instant invention.

DESCRIPTION OF THE PREFERRED EMBODIMENT

Figure 3:
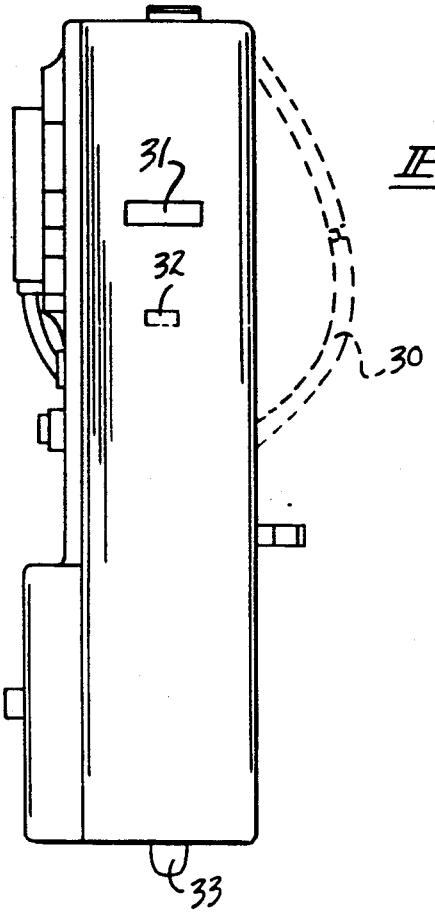
FIG. 3 is an orthographic right side view of the instant invention.
Figure 4:
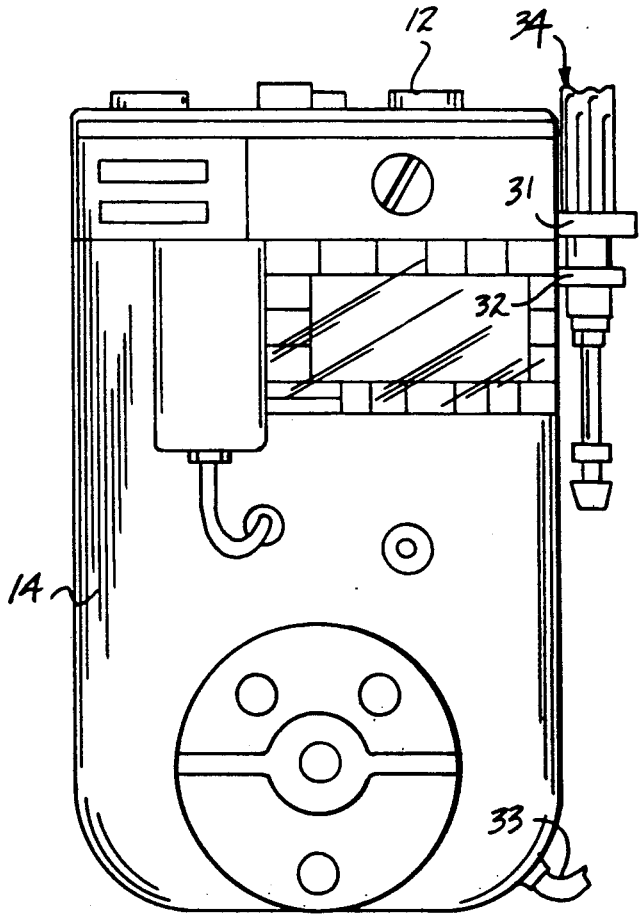
FIG. 4 is an orthographic rear view, taken in elevation, of the invention.
Figure 7:
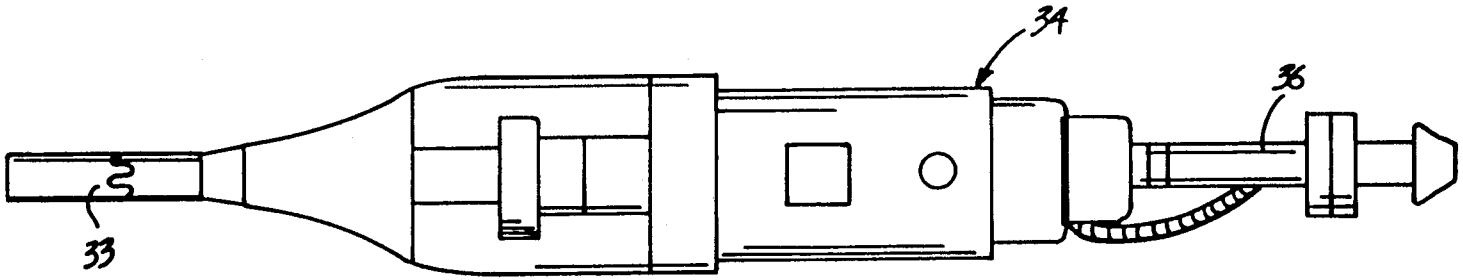
FIG. 7 is an orthographic top view of the squirt gun utilized by the instant invention.
Figure 8:
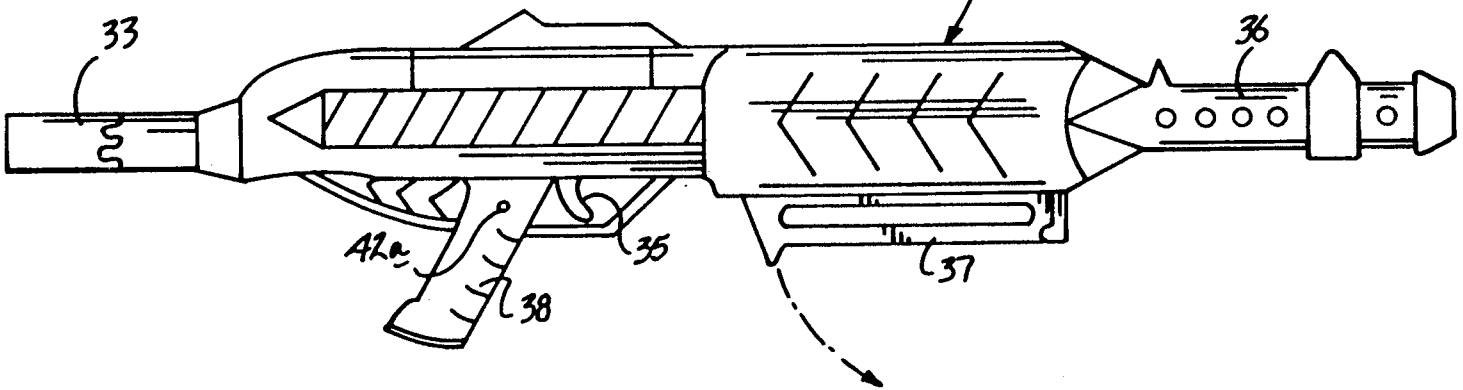
FIG. 8 is an orthographic side view of a squirt gun utilized by the instant invention.

With reference now to the drawings, and in particular to FIGS. 1 to 10 thereof, a new and improved toy apparatus embodying the principle and concepts of the present invention and generally designated by the reference numeral 10 will be described.

More specifically, the toy apparatus 10 of the instant invention essentially comprises a hollow housing 11, including a central cavity. The central cavity is accessed through a housing cap 12 that is removably mounted to a top wall 13 of the housing. A rear wall 14 of the housing utilizes a series of projections directed exteriorly of the rear wall for providing simulation of various components mounted to the housing. A left side wall 15 of the housing is arranged generally parallel to the right side wall 16 mounting an upper and lower loop 31 and 32 to receive an associated gum member 34 therewithin. A fluid conduit 33 is in fluid communication between the gun member 34 and a rear end of the longitudinal housing of the gun member 34 and a bottom wall 13*a* of the housing, as illustrated in FIG. 2 for example.

The front wall 17 of the housing includes a respective frist right and first left front wall opening 18 and 19 arranged at opposed ends of a first horizontal belt conduit 20 that projects through the housing to receive a first belt 21 therethrough. The first belt 21 includes clasp members at each terminal end for securement of opposed terminal ends of the belt together, wherein the first belt 21 is arranged for securement about a waist of a torso portion of an individual. A second right and seocnd left opening 22 and 23 respectively defines a second horizontal belt conduit 24 parallel to the first belt conduit 20, wherein the second right and left openings 22 and 23 define respective right and left ends of the conduit as the second conduit is projected through the housing 11. A third right and third left openign 25 and 26 respectively defines a third housing conduit 27 arranged parallel to the second and first housing conduits, wherein each of the second and third housing conduits 24 and 27 are arranged to receive a belt therethrough for enhanced securement to a torso of an individual, or a vertical right conduit 28 and a vertical left conduit 29 that are arranged orthogonally relative to the second and thrid conduits and are defined through the third right opening 25 and the seond right opening 22 to receive a shoulder belt 30 therethrough, wherein a further shoulder belt 30 may be directed through a vertical left conduit 29 arranged parallel to the right conduit 28 utilizing the second left opening 23 and the third left opening 26 to receive respective lower and upper terminal ends of the conduit as it projects through the front wall 17.

The gun member 34, as noted above, is defined by a longitudinal housing, including a gun nozzle 36 projecting through a forward ned of the housing coaxially aligned with the fluid ocnduit 33 projecting through the rear end of the housing. A plunger trigger 35 directs fluid through the gun nozzle 36 in a conventional manner from a reservoir, such as set forth in U.S. Pat. No. 3,116,855 incorporated herein by reference.

A fold-down handle 37 is mounted to a bottom surface of the housing of the gun member 34 for cooperation with the plunger trigger 35 and its associated trigger guard in use.

Figure 9:
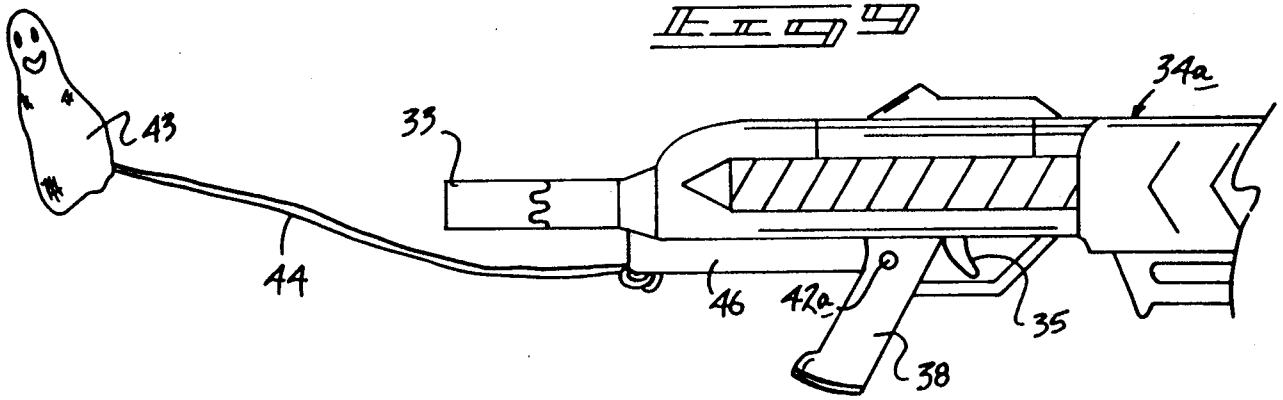
FIG. 9 is an orthographic side view of a modified squirt gun utilized by the instant invention.
Figure 11:
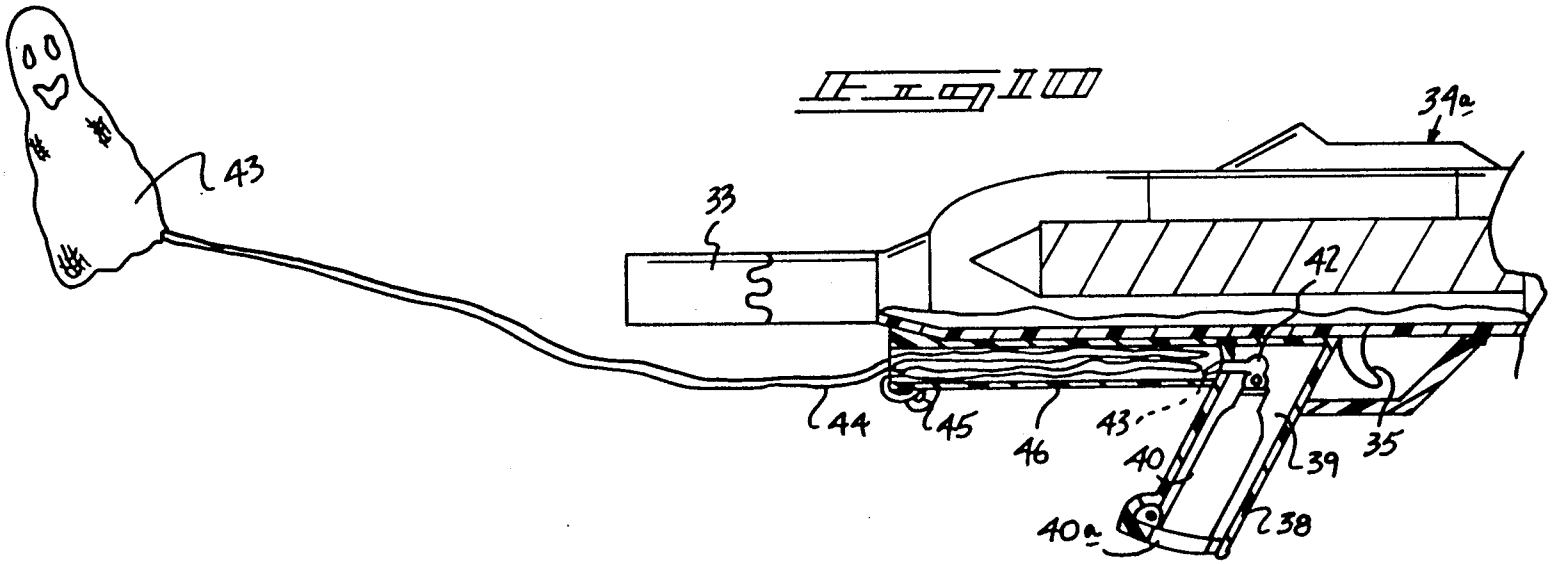

A modified gun member 34*a*, as illustrated in FIGS. 9 and 10, utilizes a fixed handle 38 positioned rearwardly of the plunger trigger 35 and on an opposed side from the fold-down handle 37, wherein the fixed handle 38 includes a fixed handle cavity 39 mounting a compressed gas cylinder 40 therewithin. A gas cylinder valve 42 is mounted to the top end of the compressed gas cylinder 40, wherein a gas cylinder valve plunger 42*a* projects from the gas cylinder valve 42 through the fixed handle 38 defined as the plunger 42*a*. A balloon housing 46 positioned rearwardly of the fixed handle 38 adjacent the fluid conduit 33 mounts a tether anchoring 45 mounting an inflation balloon tether 44 thereto, wherein an opposed end of the inflation balloon tehter 44 is mounted to an inflation balloon 43 that is in communication with the gas cylinder valve 42, whereupon opening of the gas cylinder 40 through the plunger 42*a* projects the inflation balloon 43 form the balloon housing 46 permitting an individual to aim and fire the gun through the gun nozzle 36 at the balloon 43 functioning as a target.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A toy apparatus, comprising in combination, a housing, the housing defined by a central cavity, and the housing including a housing top wall, with a cap member removably mounted to the top wall to permit filling of the cavity with fluid, and the housing including a bottom wall, wherein the bottom wall includes a fluid conduit, wherein the fluid conduit is in fluid communication with the cavity at a rear end of the conduit, and further including a gun member, the gun member including a longitudinal housing, and the longitudinal houisng including a housing rear end, wherein the rear end includes a forward end of the fluid conduit directed thereto, and the gun housing including a nozzle mounted longitudinally with the conduit projecting from a forward end of the gun housing, and a plunger trigger mounted to a bottom surface of the housing to effect directing of fluid from the gun member through the nozzle, and the housing including a housing right side wall and a housing left side wall, the housing right side wall including an upper side wall loop spaced from and parallel a lower side wall loop, and the upper side wall loop and the lower side wall loop removably mount the gun member therewithin, and the housing including a front wall, and the front wall including strap means for securement of the housing to a torso of an individual, and the housing front wall includes a first horizontal belt conduit, the first horizontal belt conduit including a first belt directed therethrough, and further including a second belt conduit and a third belt conduit, wherein the second and third belt conduits are arranged parallel to the first belt conduit and to each opening and a second left opening and a second right opening, each directed through the front wall of the housing, and the third horizontal belt conduit including a third right opening and a third left opening, each directed through the front wall of the housing defining opposed ends of the third horizontal belt conduit, and a vertical right conduit arranged orthogonally relative to the second horizontal belt conduit and the third horizontal belt conduit intersecting the second horizontal belt conduit and the third horizontal belt conduit, and a vertical left conduit arranged parallel to and spaced from the vertical right conduit intersecting the second horizontal belt conduit and the third horizontal belt conduit, wherein the vertical right conduit and the vertical left conduit receive a shoulder strap therethrough.

2. An apparatus as set forth in claim 1 wherein the gun member includes a fixed handle positioned rearwardly of the plunger trigger, and the fixed handle including a fixed handle cavity, the fixed handle cavity positioned adjacent a balloon housing, and the fixed handle cavity including a compressed gas cylinder mounted therewithin, and the compressed gas cylinder including a gas cylinder valve, and a gas cylinder valve plunger operative with the gas cylinder valve directed through the fixed handle to effect selective actuation of the gas cylinder valve, and an inflation balloon mounted within the balloon housing, and a balloon tether mounted to the balloon and to the balloon housing, whereupon inflation of the balloon from the compressed gas cylinder effects projecting of the balloon from the balloon housing for use as a target.

* * * * *